US005373126A

United States Patent [19]

Manandhar et al.

[11] Patent Number: 5,373,126

[45] Date of Patent: Dec. 13, 1994

[54] DECELERATION SENSOR SWITCH FOR USE IN A VEHICLE OCCUPANT SAFETY SYSTEM

[75] Inventors: Saroj Manandhar, Chino Hills; Robert J. Bolender, Pasadena; James Purves, Alta Loma; Long T. Su, West Covina; Thomas Antonucci, Sherman Oaks, all of Calif.

[73] Assignee: TRW Technar Inc., Irwindale, Calif.

[21] Appl. No.: 171,024

[22] Filed: Dec. 21, 1993

Related U.S. Application Data

[63] Continuation-in-part of Ser. No. 36,482, Mar. 24, 1993, Pat. No. 5,306,883.

[51] Int. Cl.[5] ..... H01H 35/14

[52] U.S. Cl. ..... 200/61.53

[58] Field of Search ..... 200/61.45 R, 61.53

[56] References Cited

U.S. PATENT DOCUMENTS

| | | | |
|---|---|---|---|
| 2,984,719 | 5/1961 | Higgs et al. | 200/83 C |
| 3,549,169 | 12/1970 | Oldberg et al. | 280/735 |
| 3,571,539 | 3/1971 | Kaiser et al. | 200/61.53 |
| 3,662,606 | 5/1972 | Prachar | 73/514 |
| 3,832,507 | 8/1974 | Marquardt et al. | 200/61.45 R |
| 4,184,057 | 1/1980 | Kumita et al. | 200/61.45 R |
| 5,053,588 | 10/1199 | Bolender | 200/61.45 R |
| 5,066,837 | 11/1991 | Gunning et al. | 200/61.45 R |
| 5,153,393 | 10/1992 | Breed et al. | 200/61.45 R |
| 5,206,496 | 4/1993 | Takeda et al. | 200/61.45 M |

OTHER PUBLICATIONS

Article entitled "Crash Sensors for Inflatable Occupant Restraint Systems" by E. Pujdowski, Eaton Corp.-Safety Systems Div. 2nd International Conference on Passive Restraints, Detroit, Michigan, May 22-25, 1972.

*Primary Examiner*—J. R. Scott

*Attorney, Agent, or Firm*—Tarolli, Sundheim & Covell

[57] ABSTRACT

A deceleration sensor switch comprises a base (**12*d*) including a plate portion (15*d*) and a rod portion (18*d*) having a longitudinal central axis (99*d*). In one embodiment (FIGS. 11-15), a rectangular mass (20*d*) is mounted on the rod portion. The mass is spaced apart from the plate portion at a distance which prevents rotation of the mass about the axis of the rod portion. When the mass moves from an unactuated position to an actuated position, the mass moves away from a releasable tab portion (42*d*) of a contact (40*d*) to allow a contact portion (52*d*) of the contact to move into engagement with an electrical terminal (34*d*). The contact portion is spaced apart a predetermined distance (D) from the terminal when the mass is in the unactuated position. The tab portion includes a pair of contact ears (334) having convex-shaped arcuate edge surfaces (338) which allow the contact portion to maintain the same predetermined distance from the terminal upon movement of the mass in a direction perpendicular to the axis of the rod portion. The mass has a protection tab (306) which prevents a cover (11*d***) from striking the contact when the cover is moved into engagement with the base.

14 Claims, 6 Drawing Sheets

DECELERATION SENSOR SWITCH FOR USE IN A VEHICLE OCCUPANT SAFETY SYSTEM

This application is a continuation in part of application Ser. No. 08/036,482, filed Mar. 24, 1993, now U.S. Pat. No. 5,306,883.

BACKGROUND OF THE INVENTION

1. Technical Field

The present invention relates to a deceleration sensor switch, and is particularly directed to a deceleration sensor switch comprising an inertia mass which moves against a spring bias in response to a predetermined deceleration.

2. Background Art

Deceleration sensor switches which include an inertia mass which moves against a Spring bias in response to a predetermined deceleration are known. One known deceleration sensor switch includes a donut-shaped inertial mass slidable on a rod against a spring bias. Another known deceleration sensor switch includes a mass disposed in a cylindrical chamber in a body and movable in the chamber against a spring bias. Also, some of the known deceleration sensor switches have means for adjusting the spring bias to adjust the responsiveness of the deceleration sensor switch.

SUMMARY OF THE INVENTION

In accordance with one embodiment of the present invention, a deceleration sensor switch comprises a base including a rod portion having a longitudinal central axis. A rectangular mass is mounted on the rod portion and is movable relative to the rod portion between an unactuated position and an actuated position along the longitudinal central axis of the rod portion. The rectangular mass moves from the unactuated position to the actuated position when the deceleration sensor switch is subjected to deceleration of a predetermined magnitude. The rectangular mass moves against a spring bias to provide a restoring force which acts on the rectangular mass to move the rectangular mass relative to the rod portion from the actuated position back to the unactuated position. The spring bias is provided by a helical coil spring helically wound around the rod portion along its longitudinal central axis.

First and second electrical terminals are electrically connectable with each other. Connecting means is provided for electrically connecting the first and second electrical terminals with each other when the mass moves from the unactuated position to the actuated position. The connecting means comprises a contact including (i) a releasable tab portion which engages the rectangular mass when the rectangular mass is in the unactuated position and which is released for movement with the rectangular mass when the rectangular mass moves from the unactuated position to the actuated position, (ii) a biasing portion which biases the tab portion into engagement with the rectangular mass, and (iii) a contact portion which is spaced apart a predetermined distance from one of the first and second electrical terminals when the rectangular mass is in the unactuated position and which contacts the one electrical terminal when the rectangular mass is in the actuated position. The releasable tab portion includes means for enabling the contact portion to maintain the predetermined distance from the one electrical terminal upon movement of the rectangular mass in a direction perpendicular to the longitudinal central axis of the rod portion.

A plate portion of the base includes a flat surface which is parallel with one side of the rectangular mass when the rectangular mass is mounted on the rod portion. The flat surface is spaced apart from the one side of the rectangular mass at a distance which prevents rotation of the rectangular mass about the longitudinal central axis of the rod portion. Protection tab means is disposed on the rectangular mass. The protection tab means prevents a cover engageable with the base from striking the connecting means when the cover is moved towards the base to engage the base. The cover engages the base to enclose the rectangular mass and the helical coil spring.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DESCRIPTION OF PREFERRED EMBODIMENTS

Figure 1:
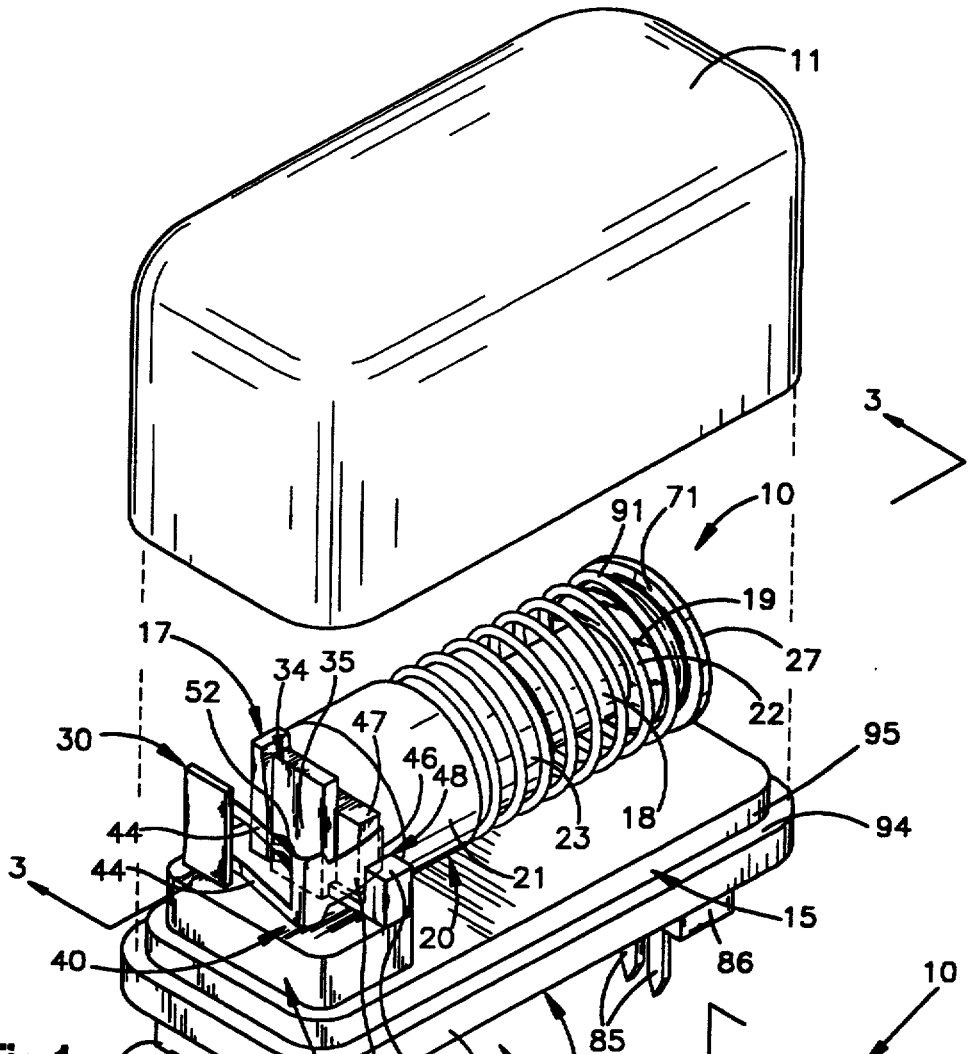
FIG. 1 is a perspective view of a deceleration sensor switch constructed in accordance with the present invention and looking at the switch at a given angle.

The present invention is directed to a deceleration sensor switch comprising a mass which moves against a spring bias. A deceleration sensor switch in accordance with the present invention may be used in a variety of different systems. Preferably, the deceleration sensor switch is used in a vehicle occupant safety system, such as an air bag system, to trigger inflation of an air bag in the event of vehicle deceleration indicative of a vehicle collision. A deceleration sensor switch 10 constructed in accordance with the present invention is shown in FIG. 1.

The deceleration sensor switch 10 comprises a base 12. The base 12 includes a bottom plate portion 14 and a top plate portion 15 located above the bottom plate portion 14. The bottom plate portion 14 lies in a flat plane. The top plate portion 15 lies in another flat plane which is parallel to the flat plane in which the bottom plate portion 14 lies. The bottom plate portion 14 has a main body part 82, a first terminal support part 84 located adjacent one end of the main body part 82, and a second terminal support part 86 located adjacent an opposite end of the main body part 82. The first and second terminal support parts 84, 86 project away from the main body part 82.

Figure 2:
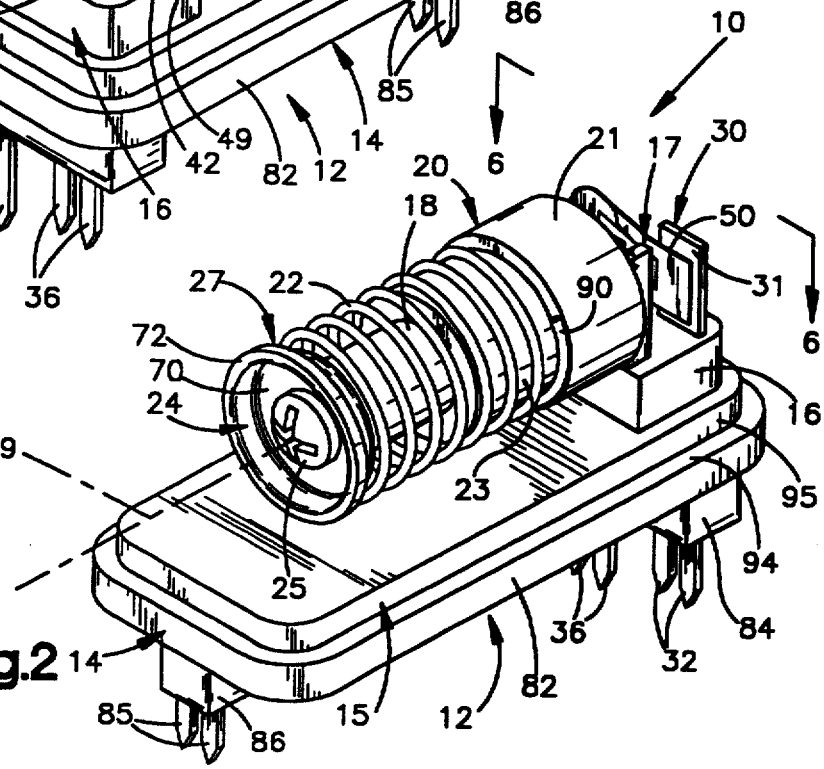
FIG. 2 is another perspective view of the deceleration sensor switch of FIG. 1 and looking at the switch at a different angle.

As shown in FIGS. 1 and 2, the bottom plate portion 14 is larger than the top plate portion 15. The top plate portion 15 overlies part of the bottom plate portion 14 in such a way that a ledge 94 of uniform width is formed around the outer periphery of the base 12. The top plate portion 15 has a side wall 95 which extends around the outer periphery of the top plate portion 15. The side wall 95 extends perpendicular to the ledge 94. A cover 11 (shown only in FIG. 1) is sealingly engageable against the side wall 95 of the top plate portion 15 and the ledge 94 of the bottom plate portion 14 to seal and protect the deceleration sensor switch 10.

The base 12 further includes a horizontal pedestal portion 16 located above the top plate portion 15 and a vertical pedestal portion 17 located above the horizontal pedestal portion 16. The horizontal pedestal portion 16 overlies part of the top plate portion 15 and the vertical pedestal portion 17 projects perpendicularly away from the horizontal pedestal portion 16. The vertical pedestal portion 17 has a first vertically projecting part 47 and a second vertically projecting part 49 which is smaller than the first vertically projecting part 47. A vertically extending slot 48 is defined between the first and second vertically projecting parts 47, 49 of the vertical pedestal portion 17.

Figure 3:
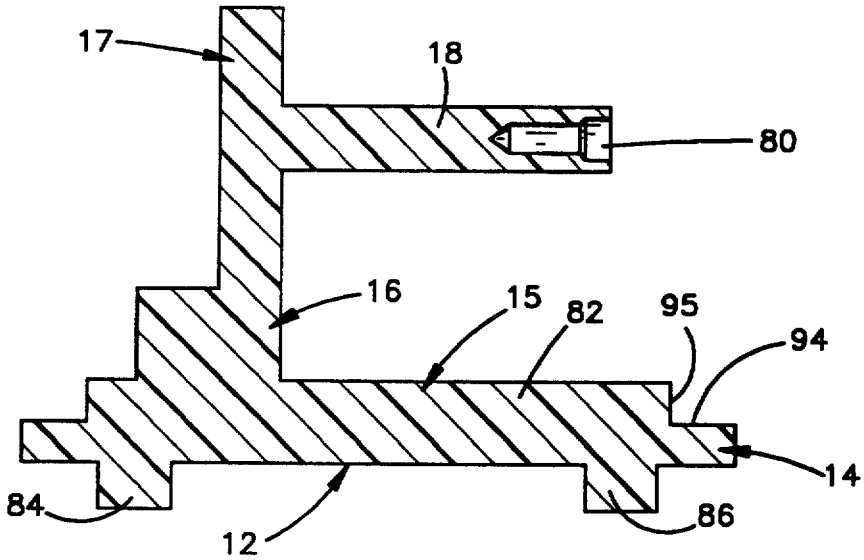
FIG. 3 is a sectional view, taken approximately along line 3—3 of FIG. 1 and with parts removed, showing a base of the deceleration sensor switch of FIG. 1.

The base 12 further includes a tubular rod portion 18 spaced from the top plate portion 15 and cantilevered from the vertical pedestal portion 17. The rod portion 18 has a free end 19 (FIG. 1) and a longitudinal central axis 99 (FIG. 2) which extends parallel to the flat planes in which the top and bottom plate portions 14, 15 lie. The rod portion 18, the horizontal and vertical pedestal portions 16, 17, and the top and bottom plate portions 14, 15 are a single continuous piece of molded plastic material, as best shown in the sectional view of FIG. 3.

Figure 6:
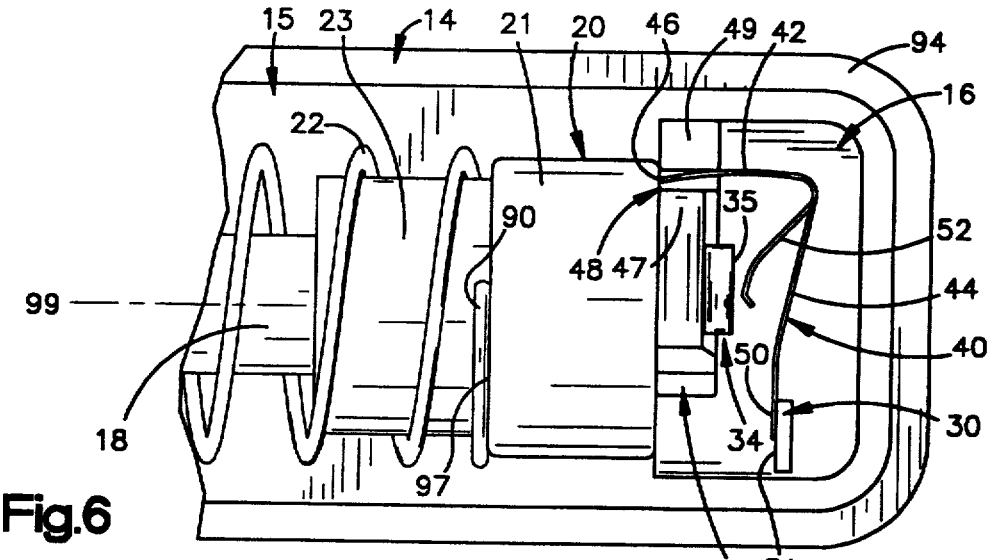
FIG. 6 is an enlarged view of a portion of the deceleration sensor switch of FIG. 2 as viewed in the direction along line 6—6 in FIG. 2.
Figure 8:
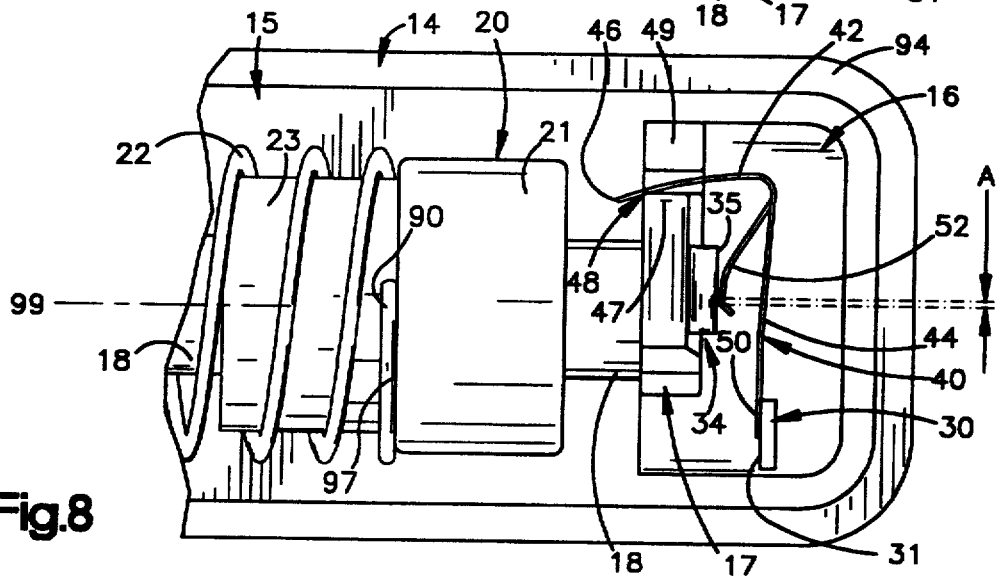
FIG. 8 is a view similar to FIG. 7 but showing parts of the deceleration sensor switch in still other positions.

A mass 20 is mounted on the rod portion 18 and is movable relative to the rod portion 18 between an unactuated position shown in FIG. 6 and an actuated position shown in FIG. 8 along the longitudinal central axis 99 of the rod portion 18. The mass 20 has a first ring-like portion 21 having a cross-sectional outer diameter and a second ring-like pilot portion 23 having a cross-sectional outer diameter smaller than the cross-sectional outer diameter of the first ring-like portion 21. The first and second ring-like portions 21, 23 are coaxial.

A spring 22 in the forte of a helical coil spring is helically wound around the rod portion 18 along its longitudinal central axis 99. The spring 22 has one end 90 (FIG. 2) and another end 91 (FIG. 1) located opposite the one end 90. The second ring-like pilot portion 23 of the mass 20 extends into the end 90 of the spring 22 to support and guide the spring 22. The end 90 of the spring 22 abuts against a ring-shaped surface 97 (FIG. 6) at one end of the first portion 21 of the mass 20. The spring bias of the spring 22 presses against the ring-shaped surface 97 of the first portion 21 of the mass 20 to press the mass 20 into engagement with the vertical pedestal portion 17.

As shown in FIG. 2, an adjustable calibration member 24 in the form of a threaded screw having a head portion 25 is screwed into the free end 19 of the rod portion 18. The rod portion 18 has a cylindrical hole 80 (shown only in FIG. 3) in which the threads of the threaded screw 24 engage. A washer 27 is located between the head portion 25 of the threaded screw 24 and the free end 19 of the rod portion 18.

Figure 4:
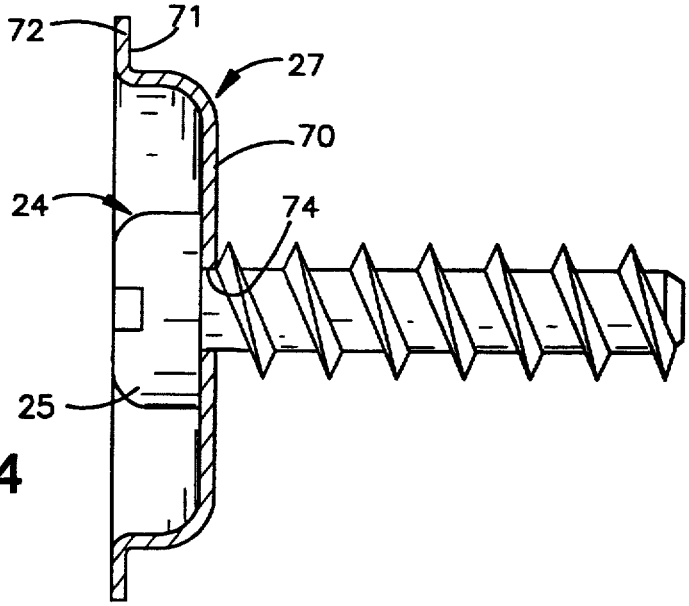
FIG. 4 is an enlarged view of a disc-shaped washer used in the deceleration sensor switch of FIG. 1.

As shown in enlarged detail in FIG. 4, the washer 27 includes a ring-like pilot portion 70 and a ring-like flange portion 72 extending from the ring-like pilot portion 70. The ring-like portions 70, 72 are coaxial. The ring-like pilot portion 70 of the washer 27 extends into the end 91 of the spring 22 to support and guide the spring 22. The end 91 of the spring 22 abuts against a ring-shaped surface 71 (FIG. 4) on the ring-like flange portion 72 of the washer 27. The spring bias of the spring 22 presses against the ring-shaped surface 71 of the ring-like flange portion 72 of the washer 27 to press the washer 27 into engagement with the head portion 25 of the threaded screw 24. The threaded screw 24 is received in a hole 74 (FIG. 4) which extends through the ring-like pilot portion 70 of the washer 27.

The threaded screw 24 can be rotated clockwise or counterclockwise to either move the washer 27 towards the free end 19 of the rod portion 18 or to allow the washer 27 to move away from the free end 19 of the rod portion 18 due to the spring bias of the spring 22 acting on the washer 27. Therefore, the position of the washer 27 relative to the free end 19 of the rod portion 18 can be adjusted by rotating the threaded screw 24 clockwise or counterclockwise. The spring bias of the spring 22 acting on the mass 20 depends upon the position of the washer 27 relative to the free end 19 of the rod portion 18. Thus, the spring bias of the spring 22 acting on the mass 20 can be adjusted by rotating the threaded screw 24 either clockwise or counterclockwise.

A terminal 30 made of a suitable electrical current conducting material, preferably stainless steel, is insert molded into the horizontal pedestal portion 16, the top plate portion 15, the main body part 82 of the bottom plate portion 14, and the first terminal support part 84 of the bottom plate portion 14. The terminal 30 has bifurcated leg portions 32 which extend away from the first terminal support part 84 of the bottom plate portion 14. One of the leg portions 32 is connectable to a negative terminal of a voltage supply and the other one of the leg portions 32 is connectable to an external resistor for diagnostic purposes. The end of the terminal 30 opposite the leg portions 32 is one of a pair of electrical terminals of the deceleration sensor switch 10.

Another terminal 34 also made of a suitable electrical current conducting material, preferably stainless steel, is insert molded into the horizontal pedestal portion 16, the top plate portion 15, the main body part 82 of the bottom plate portion 14, and the first terminal support part 84 of the bottom plate 14. The terminal 34 has bifurcated leg portions 36 which extend away from the first terminal support part 84 of the bottom plate portion 14. One of the leg portions 36 is connectable to a positive terminal of a voltage supply and the other one of the leg portions 36 is connectable to an external resistor for diagnostic purposes. The end of the terminal 34 opposite the leg portions 36 is the other one of the pair of electrical terminals of the deceleration sensor switch 10.

A pair of leg portions 85 are insert molded into the second terminal support part 86. The leg portions 85 extend away from the second terminal support part 86 in the same direction as the leg portions 32 of the terminal 30 and the leg portions 36 of the terminal 34 extend away from the first terminal support part 84. The three leg portions 32, 36, 85 support the deceleration sensor switch 10 when the deceleration sensor switch 10 is mounted for use.

Figure 5:
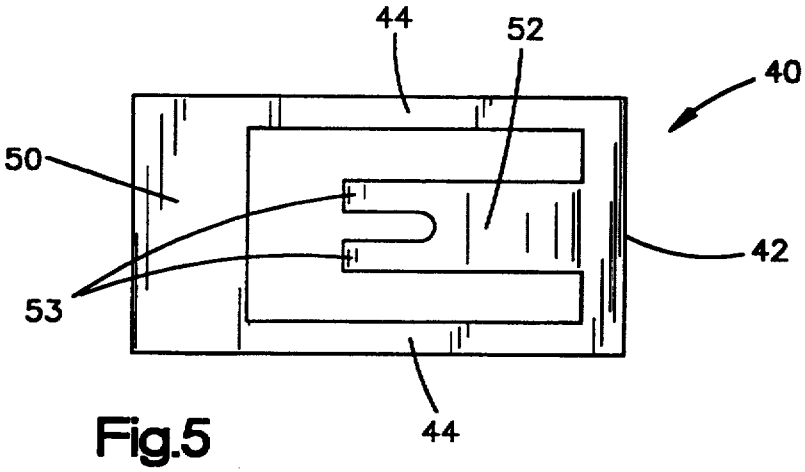
FIG. 5 is a plan view of a movable contact used in the deceleration sensor switch of FIG. 1.

As best shown in FIGS. 1, 5 and 6, a movable contact 40 made of stainless steel includes a releasable tab portion 42 and two generally parallel strip portions 44 extending from the tab portion 42. An edge 46 of the tab portion 42 extends through the vertically extending slot 48 defined between the first and second vertically projecting parts 47, 49 of the vertical pedestal portion 17. The contact 40 also includes an end portion 50 which interconnects the two parallel strip portions 44. The end portion 50 is welded to a flat surface 31 of the terminal 30 so that the two parallel strip portions 44 of the contact 40 extend horizontally, as viewed in FIG. 1. The two parallel strip portions 44 act like leaf springs to provide a spring-like force which presses the edge 46 of the tab portion 42 into contact with the first portion 21 of the mass 20.

The contact 40 also has a contact portion 52 which extends from the tab portion 42 and is located between the two parallel strip portions 44, as best shown in FIGS. 1, 5 and 6. The contact portion 52 has a pair of spring-like legs 53 (best shown in FIG. 5) which are contactable with a surface 35 (FIGS. 1 and 5) of the terminal 34. When the legs 53 of the contact portion 52 are not contacting the surface 35 of the terminal 34, the terminal 34 and the terminal 30 are not electrically connected. When the terminal 34 and the terminal 30 are not electrically connected, the deceleration sensor switch 10 is in a fully opened condition, as shown in FIG. 6. When the deceleration sensor switch 10 is in the fully opened condition shown in FIG. 6, the first portion 21 of the mass 10 abuts against the vertical pedestal portion 17 and against the edge 46 of the tab portion 42 so as to maintain the contact portion 52 spaced apart from the surface 35 of the terminal 34.

When the deceleration sensor switch 10 is subjected to deceleration of a predetermined magnitude, such as occurs in a vehicle collision, the mass 20 begins to slide along the rod portion 18 and in a direction against the bias of spring 22 to compress the spring 22. As the mass 20 begins to slide along the rod portion 18 toward the left, as viewed in FIGS. 6–8, the mass 20 moves away from the vertical pedestal portion 17 and the edge 46 of the tab portion 42.

Figure 7:
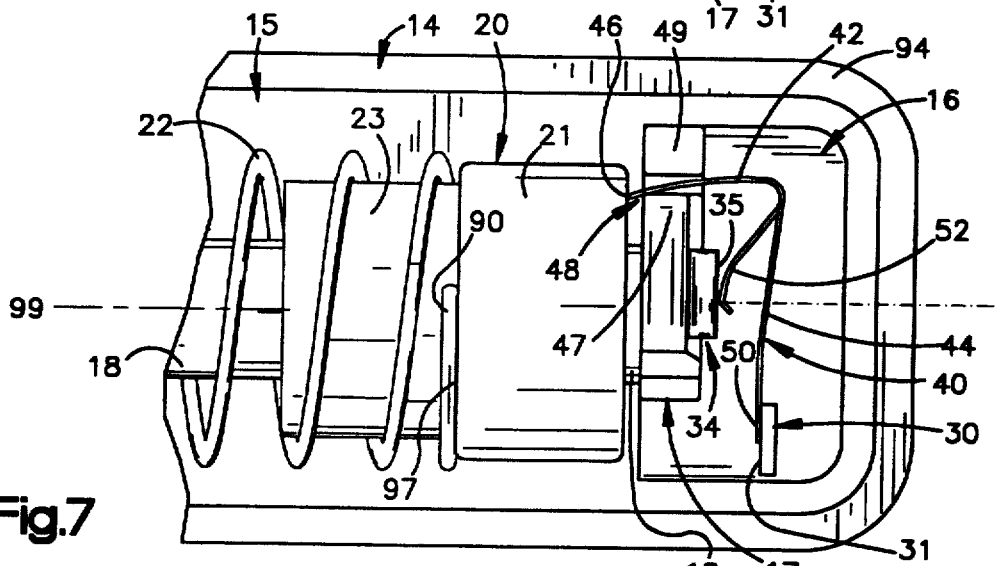
FIG. 7 is a view similar to FIG. 6 but showing parts of the deceleration sensor switch in different positions.

As the mass 20 moves away from the edge 46 of the tab portion 42, the tab portion 42 is released and slides through the slot 48 (towards the left as viewed in FIGS. 6–8) due to the spring-like force of the two parallel strip portions 44 acting on the tab portion 42. The tab portion 42 continues to slide through the slot 48 until the legs 53 of the contact portion 52 move into an initial contact position relative to the surface 35 of the terminal 34, as shown in FIG. 7, to establish initial electrical connection between the terminal 34 and the terminal 30. When the legs 53 of the contact portion 52 are in their initial contact position shown in FIG. 7 and initial electrical connection is established between the terminal 34 and the terminal 30, the deceleration sensor switch 10 is in an initial closed condition.

After the legs 53 of the contact portion 52 move into its initial contact position relative to the surface 35 of the terminal 34, as shown in FIG. 7, the mass 20 continues to move away from the edge 46 of the tab portion 42 to further compress the spring 22. As the mass 20 continues to move away from the edge 46 of the tab portion 42 to further compress the spring 22, the tab portion 42 continues to slide through the slot 48 due to the spring-like force of the two parallel strip portions 44 acting on the tab portion 42. As the tab portion 42 continues to slide through the slot 48, the legs 53 of the contact portion 52 wipe (slide) across the surface 35 of the terminal 34.

The legs 53 of the contact portion 52 continue to wipe across the surface 35 of the terminal 34 until they reach a final contact position, as shown in FIG. 8. When the legs 53 of the contact portion 52 reach the final contact position shown in FIG. 8, the tab portion 42 stops sliding through the slot 48. However, the mass 20 may continue to slide farther along the rod portion 18 and to move farther away from the edge 46 of the tab portion 42, as shown in FIG. 8, due to the deceleration forces acting on the deceleration sensor switch 10.

During their wiping movement from their initial contact position shown in FIG. 7 to their final contact position shown in FIG. 8, the legs 53 of the contact portion 52 move a certain distance, designated with reference letter A in FIG. 8, across the surface 35 of the terminal 34. The distance A is relatively small, but is shown exaggerated in FIG. 8 for purposes of illustration. Electrical contact between the terminal 34 and the terminal 30 is maintained during wiping movement of the legs 53 of the contact portion 52 from their initial contact position shown in FIG. 7 to their final contact position shown in FIG. 8. When the legs 53 of the contact portion 52 are in their final contact position shown in FIG. 8 and electrical contact is maintained between the terminal 34 and the terminal 30, the deceleration sensor 10 is in a fully closed condition.

By allowing the legs 53 of the contact portion 52 to wipe across the surface 35 of the terminal 34 as the legs 53 of the contact portion 52 move from their initial contact position shown in FIG. 7 to their final contact position shown in FIG. 8, the electrical connection between the terminal 34 and the terminal 30 is very reliable. This is because the wiping motion helps to overcome any small particles which may be present between the surface 35 of the terminal 34 and the legs 53 of the contact portion 52. Also, the wiping motion results in a rubbing action between two contact areas. This rubbing action helps to penetrate through any oxides, corrosion, or other non-conducting film which may be present on the contact areas between the surface 35 of the terminal 34 and the legs 53 of the contact portion 52.

The mass 20 begins to move from its actuated position shown in FIG. 8 back toward its unactuated position shown in FIG. 6 due to the spring bias of the spring 22 when the deceleration forces which caused the movement of the mass 20 to its actuated position dissipates.

As viewed in FIG. 8, the mass 20 begins to move toward the right. The mass 20 continues to move toward the right until the first portion 21 of the mass 20 comes into initial contact with the edge 46 of the tab portion 42 of the contact 40.

After the first portion 21 of the mass 20 comes into initial contact with the edge 46 of the tab portion 42, the mass 20 continues to move to the right. As this occurs, the mass 20 presses against the edge 46 of the tab portion 42 to slide the tab portion 42 through the slot 48 (towards the right as viewed in FIGS. 6–8). The mass 20 continues to move to the right and the tab portion 42 continues to slide through the slot 48 until the legs 53 of the contact portion 52 move away from the surface 35 of the terminal 34. The mass then continues to move to the right until eventually the mass 20 reaches its unactuated position shown in FIG. 6. When the mass 20 reaches its unactuated position shown in FIG. 6, the tab portion 42 stops sliding through the slot 48 and the contact portion 52 stops moving away from the surface 35 of the terminal 34. The deceleration sensor switch 10 is thus returned to its fully opened condition, as shown in FIG. 6.

Figure 9:
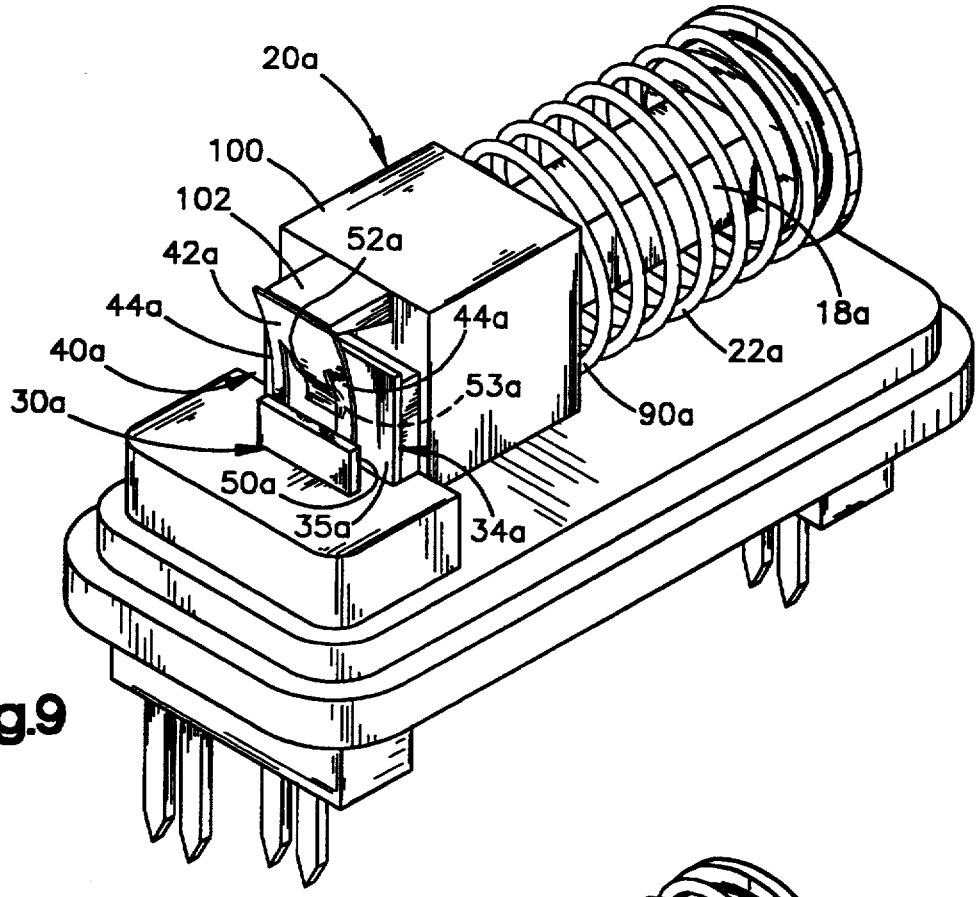
FIG. 9 is a perspective view, similar to the perspective view shown in FIG. 1, of a second embodiment of the present invention.

A second embodiment of the present invention is illustrated in FIG. 9. Since the embodiment of the invention illustrated in FIG. 9 is generally similar to the embodiment of the invention illustrated in FIG. 1, similar numerals are utilized to designate similar components, the suffix letter "a" being associated with the embodiment of FIG. 9 to avoid confusion.

The end 50*a* of the contact 40*a* is welded to the terminal 30*a* so that the two parallel strip portions 44*a* of the contact 40*a* extend vertically, as viewed in FIG. 9. Also, in the embodiment of FIG. 9, the rod 18*a* is generally rectangular in cross section and the mass 20*a* is generally rectangular in cross section. The mass 20*a* has a rectangular-shaped central opening (not shown) which has a shape complementary to the shape of the rod 18*a* and through which the rectangular-shaped rod 18*a* extends. The one end 90*a* of the spring 22*a* is received in a cylindrical hollow (also not shown) in the mass 20*a* to support and guide the spring 22*a*.

The mass 20*a* has a main portion 100 and a protruding portion 102 which extends from the main portion 100. The protruding portion 102 of the mass 20*a* engages the tab portion 42*a* of the contact 40*a* when the mass 20*a* is in its unactuated position, as shown in FIG. 9. When the protruding portion 102 engages the tab portion 42*a*, as shown in FIG. 9, the legs 53*a* of the contact portion 52*a* of the contact 40*a* are spaced apart from the surface 35*a* of the terminal 34*a*. Thus, the terminal 30*a* is not electrically connected with the terminal 34*a* when the mass 20*a* is in its unactuated position, as shown in FIG. 9.

When the mass 20*a* moves to its actuated position (not shown), the mass 20*a* slides along the rod 18*a* in a direction against the bias of the spring 22*a* to compress the spring 22*a*. As this occurs, the protruding portion 102 of the mass 20*a* moves away from the tab portion 42*a* of the contact 40*a*. This allows the spring-like force of the two parallel strip portions 44*a* acting on the tab portion 42*a* to move the legs 53*a* of the contact portion 52*a* of the contact 40*a* into engagement with the surface 35*a* of the terminal 34*a*. Thus, the terminal 30*a* is electrically connected with the terminal 34*a* when the mass 20*a* is in its actuated position.

Figure 10:
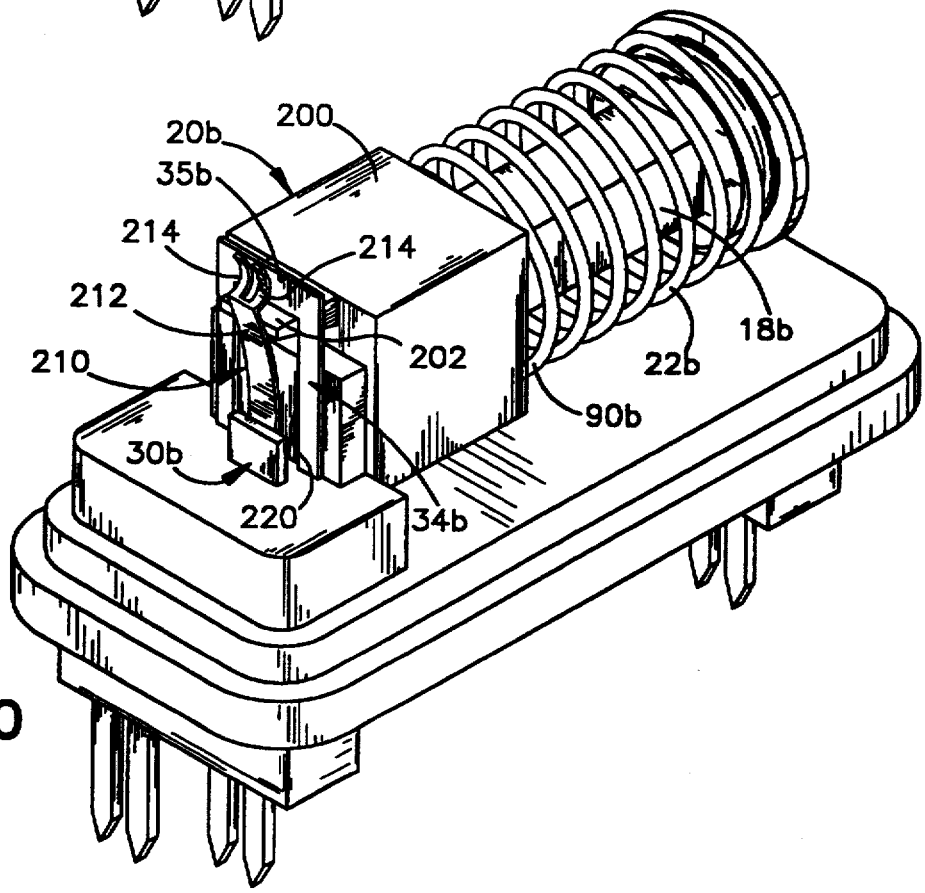
FIG. 10 is a perspective view, similar to the perspective view shown in FIG. 9, of a third embodiment of the present invention.
Figure 12:
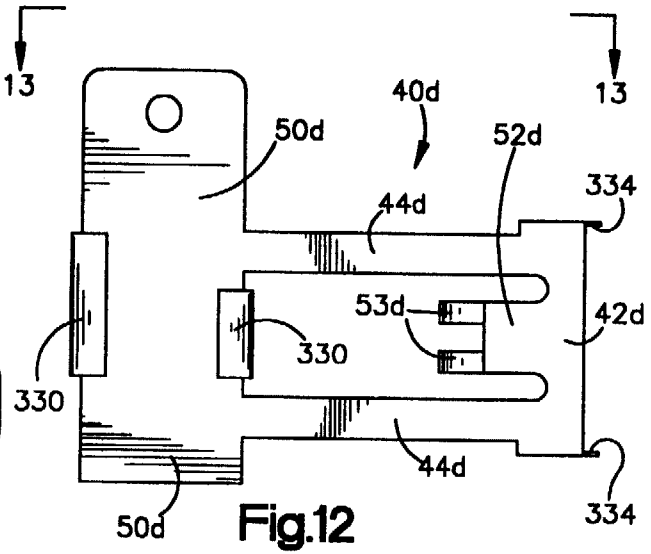
FIG. 12 is a plan view of a movable contact used in the deceleration sensor switch of FIG. 11.
Figure 13:
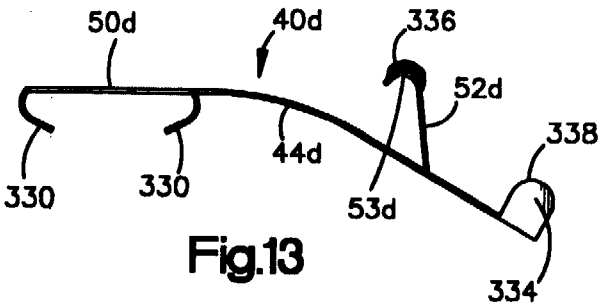
FIG. 13 is a view of the movable contact of FIG. 12 as viewed in the direction along line 13—13 in FIG. 12.

A third embodiment of the present invention is illustrated in FIG. 10. Since the embodiment of the invention illustrated in FIG. 10 is generally similar to the embodiment of the invention illustrated in FIG. 1, similar numerals are utilized to designate similar components, the suffix letter "b" being associated with the embodiment of FIG. 10 to avoid confusion.

As shown in FIG. 10, a contact 210 includes a stem portion 212 and a pair of legs 214 extending from the stem portion 212. The stem portion 212 is welded to the terminal 30*b*. The terminal 34*b* has the general shape of a horseshoe having an opening 220. In the embodiment of FIG. 10, the rod 18*b* is generally rectangular in cross section and the mass 20*b* is generally rectangular in cross section. The mass 20*b* has a rectangular-shaped central opening (not shown) which has a shape complementary to the shape of the rod 18*b* and through which the rectangular-shaped rod 18*b* extends. The one end 90*b* of the spring 22*b* is received in a cylindrical hollow (also not shown) in the mass 20*b* to support and guide the spring 22*b*.

The mass 20*b* has a main portion 200 and a protruding portion 202 which extends from the main portion 200. The protruding portion 202 of the mass 20*b* extends through the opening 220 and engages the stem portion 212 when the mass 20*b* is in its unactuated position, as shown in FIG. 10. When the protruding portion 202 engages the stem portion 212, as shown in FIG. 10, the legs 214 of the contact 210 are spaced apart from the surface 35*b* of the terminal 34*b*. Thus, the terminal 30*b* is not electrically connected with the terminal 34*b* when the mass 20*b* is in its unactuated position, as shown in FIG. 10.

When the mass 20*b* moves to its actuated position (not shown), the mass 20*b* slides along the rod 18*b* in a direction against the bias of the spring 22*b* to compress the spring 22*b*. As this occurs, the protruding portion 202 of the mass 20*b* moves away from the stem portion 212 of the contact 210. This allows the spring-like force of the stem portion 212 acting on the legs 214 to move the legs 214 into engagement with the surface 35*b* of the terminal 34*b*. Thus, the terminal 30*b* is electrically connected with the terminal 34*b* when the mass 20*b* is in its actuated position.

A fourth embodiment of the present invention is illustrated in FIGS. 11–15. Since the embodiment of the invention illustrated in FIGS. 11–15 is generally similar to the embodiment of the invention illustrated in FIG. 1, similar numerals are utilized to designate similar components, the suffix letter "d" being associated with the embodiment of FIGS. 11–15 to avoid confusion.

Figure 11:
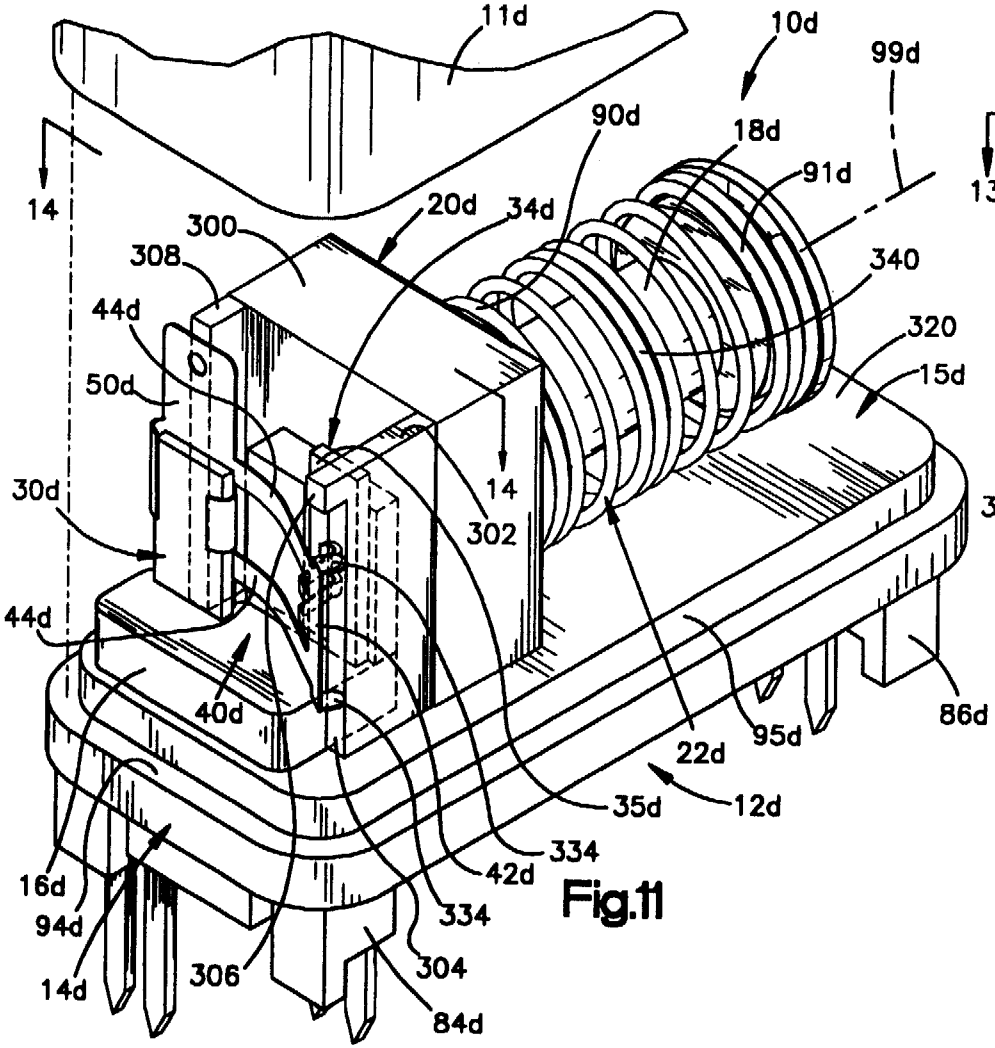
FIG. 11 is a perspective view, similar to the perspective view shown in FIG. 1, of a fourth embodiment of the present invention.
Figure 14:
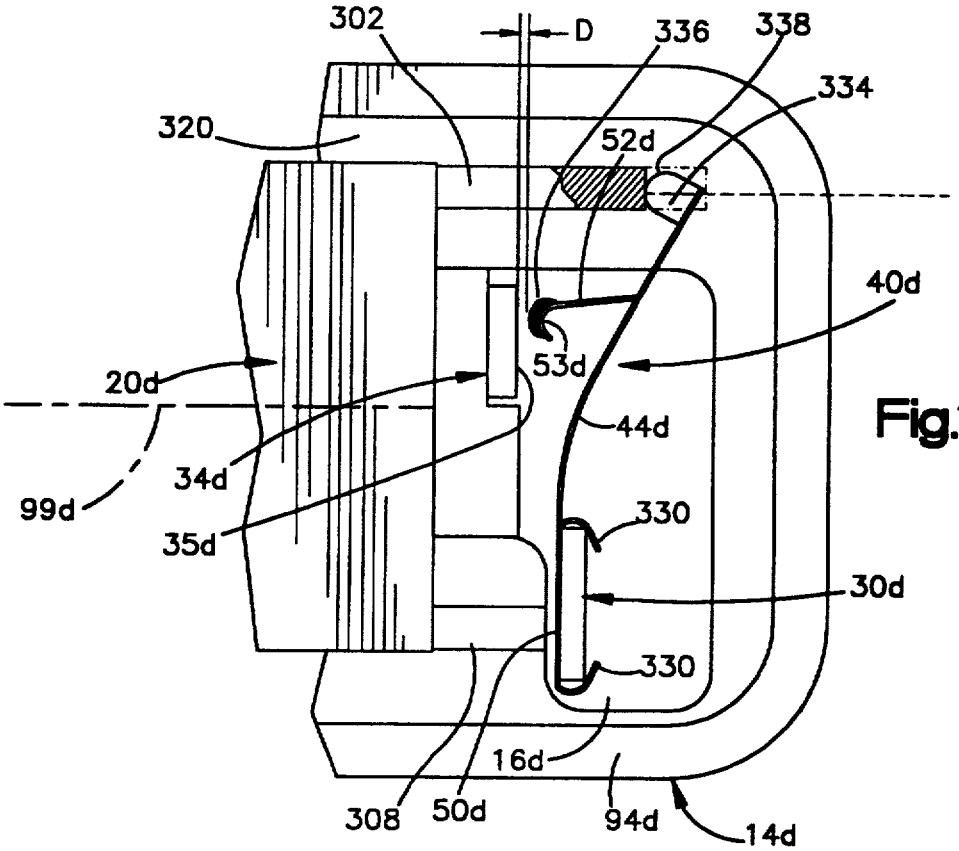
FIG. 14 is an enlarged view of a portion of the deceleration sensor switch of FIG. 11 with some parts removed, as viewed in the direction along line 14—14 in FIG. 11.

As shown in FIG. 11, the mass 20*d* has a main portion 300 and first and second projection portions 302, 308 which extend from the main portion 300. The second projection portion 308 of the mass 20*d* engages the horizontal pedestal portion 16*d* when the mass 20*d* is in its unactuated position, as shown in FIGS. 11 and 14. The first projection portion 302 of the mass 20*d* has a flat surface 304 which faces the tab portion 42*d* of the contact 40*d*. The mass 20*d* also has a protection tab 306 extending from the flat surface 304 of the first projection portion 302. The protection tab 306 prevents the cover 11*d* from striking the contact 40*d* when the cover 11*d* is moved into sealing engagement against the side wall 95*d* of the top plate portion 15*d* and the ledge 94*d* of the bottom plate portion 14*d* to seal and protect the deceleration sensor switch 10*d*.

The first and second terminal parts 84*d*, 86*d* allow the base 12*d* to be mounted above a printed circuit board with space between the base 12*d* and the printed circuit board. Components to be mounted on the printed circuit board may be accommodated in this space between the base 12d and the printed circuit board.

As shown in FIG. 11, the spring 22d has a central portion 340 with a relatively small pitch. Also, each of the ends 90d, 91d of the spring 22d has a relatively small pitch. The pitch of the ends 90d, 91d and the pitch of the central portion 340 are relatively small compared to the pitch of other portions of the spring 22d.

The mass 20d is rectangular and has a flat bottom surface (not shown) which lies parallel with a top flat surface 320 of the top plate portion 15d. The flat bottom surface of the rectangular mass 20d is spaced apart from the top flat surface 320 at a distance which prevents rotation of the rectangular mass 20d about the longitudinal central axis 99d of the rod portion 18d. The rectangular mass 20d may have a square shape.

Referring to FIGS. 11–14, the end 50d of the contact 40d is welded to the terminal 30d so that the two parallel strip portions 44d of the contact 40d extend horizontally, as viewed in FIG. 11. A pair of lip portions 330 extend from the end 50d of the contact 40d and wrap around the terminal 30d to further secure the end 50d to the terminal 30d. Each of the legs 53d of the contact portion 52d has a silver nickel button 336 welded onto the free end of the leg to increase the thermal mass of the leg and thereby to increase the current carrying capacity of the leg. The tab portion 42d of the contact 40d has a pair of contact ears 334 which extend parallel with each other. The contact ears 334 have convex-shaped arcuate edge surfaces 338 which engage the flat surface 304 of the first projection portion 302 of the mass 20d when the mass 20d is in its unactuated position, as shown in FIGS. 11 and 14.

When the mass 20d moves to its actuated position (not shown), the mass 20d slides along the rod portion 18d in a direction against the bias of the spring 22d to compress the spring 22d. As this occurs, the flat surface 304 on the first projection portion 302 of the mass 20d moves away from the arcuate edge surfaces 338 of the contact ears 334. This allows the spring-like force of the two parallel strip portions 44d acting on the legs 53d of the contact portion 52d to move into engagement with the surface 35d of the terminal 34d. Thus, the terminal 30d is electrically connected with the terminal 34d when the mass 20d is in its actuated position.

When the mass 20d is in its unactuated position as shown in FIG. 14, the contact portion 52d of the contact 40d is spaced apart a predetermined distance from the terminal 34d. This predetermined distance is designated with the letter "D", as shown in FIG. 14. It should be noted that the protection tab 306 (FIG. 11) extending from the flat surface 304 of the first projection portion 302 of the mass 20d is removed from FIG. 14 to clearly illustrate the engagement between the flat surface 304 and the convex-shaped arcuate edge surfaces 338 of the contact ears 334.

Figure 15:
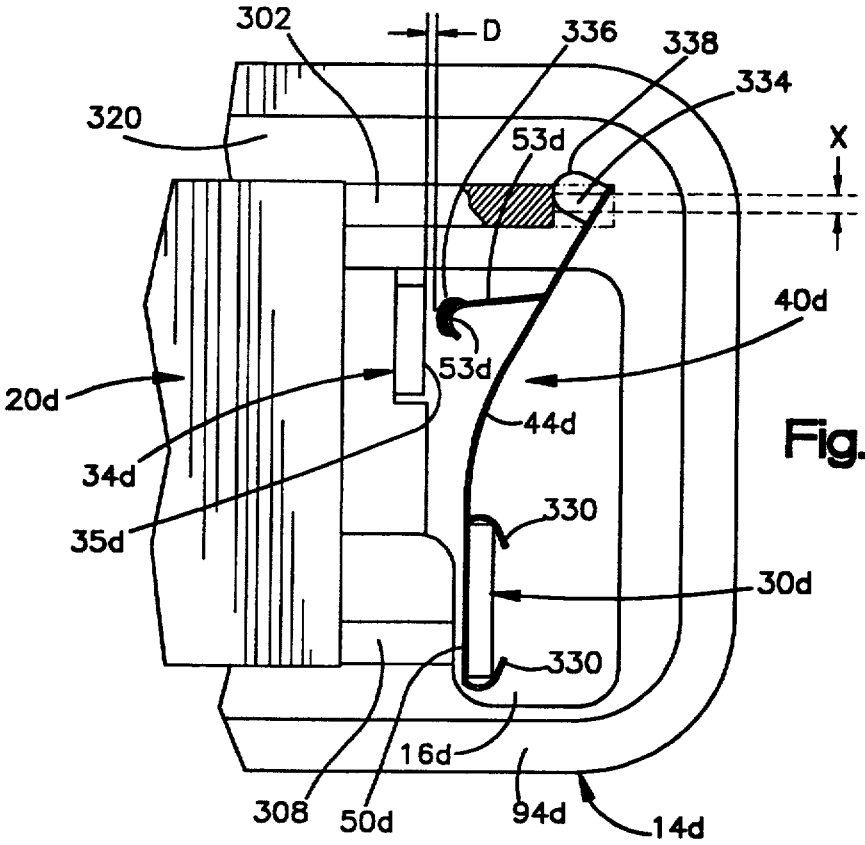
FIG. 15 is a view similar to FIG. 14 but showing parts of the deceleration sensor switch in different positions.

Although the mass 20d is slidably mounted on the rod portion 18d for sliding movement along the longitudinal central axis 99d of the rod portion 18d, it is possible that the mass 20d may have some lateral play relative to the rod portion 18d. For example, the mass 20d may move from the position shown in FIG. 14 to the position shown in FIG. 15, i.e., in a direction perpendicular to the longitudinal central axis 99d of the rod portion 18d. As viewed in FIG. 15, the position of the mass 20d is downward from the position of the mass 20d shown in FIG. 14. The distance the mass 20d moved from the position shown in FIG. 14 to the position shown in FIG. 15 is designated with the letter "X" in FIG. 15. The actual distance the mass 20d may move laterally relative to the rod portion 18d is relatively small, but is shown exaggerated in FIG. 15 for purposes of illustration.

When the mass 20d moves from the position shown in FIG. 14 to the position shown in FIG. 15, the flat surface 304 of the first projection portion 302 of the mass 20d wipes across the convex-shaped arcuate edge surfaces 338 of the contact ears 334. The convex shape of the arcuate edge surfaces 338 allows the distance between the surface 35d of the terminal 34d and the silver nickel button 336 on each of the legs 53d of the contact portion 52d of the contact 40d to be maintained at the same distance D as the flat surface 304 wipes across the arcuate edge surfaces 338 of the contact ears 334. Thus, the same distance D is maintained between the surface 35d of the terminal 34d and the silver nickel button 336 on each of the legs 53d of the contact portion 52d of the contact 40d when the mass 20d is in its unactuated position and the mass 20d moves in a direction perpendicular to the longitudinal central axis 99d of the rod portion 18d.

As previously mentioned, the rectangular mass 20d is prevented from rotating about the longitudinal central axis 99d of the rod portion 18d. By preventing the rectangular mass 20d from rotating about the longitudinal central axis 99d of the rod portion 18d, the flat surface 304 of the first projection portion 302 of the mass 20d is prevented from moving out of proper alignment relative to the arcuate edge surfaces 338 of the contact ears 334.

From the above description of the invention, those skilled in the art to which the present invention relates will perceive improvements, changes and modifications. Such improvements, changes and modifications within the skill of the art to which the present invention relates are intended to be covered by the appended claims.

Having described the invention, the following is claimed:

1. A deceleration sensor switch comprising:

a base including a rod portion having a longitudinal central axis;

a mass mounted on said rod portion and movable relative to said rod portion between an unactuated position and an actuated position along the longitudinal central axis of said rod portion, said mass moving from said unactuated position to said actuated position when said mass is subjected to deceleration of a predetermined magnitude;

spring means for providing a restoring force which acts on said mass to move said mass relative to said rod portion from said actuated position back to said unactuated position after Said mass has moved to said actuated position;

a first electrical terminal and a second electrical terminal electrically connectable with said first electrical terminal; and connecting means for electrically connecting said first and second electrical terminals with each other when said mass moves from said unactuated position to said actuated position, said connecting means comprising a contact including (i) a releasable tab portion which engages said mass when said mass is in said unactuated position and which is released for movement with said mass when said mass moves from said unactuated position to said actuated position, (ii) a biasing portion which biases said tab portion into engagement with said mass, and (iii) a contact portion which is spaced apart a predetermined distance from one of said first and second electrical terminals when said mass is in said unactuated position and which contacts said one electrical terminal when said mass is in said actuated position;

said releasable tab portion including means for enabling said contact portion to maintain said predetermined distance from said one electrical terminal upon movement of said mass in a direction perpendicular to the longitudinal central axis of said rod portion.

2. A deceleration sensor switch according to claim 1 wherein said mass includes a projection portion having an edge surface against which said releasable tab portion engages when said mass is in said unactuated position.

3. A deceleration sensor switch according to claim 2 wherein said enabling means includes an arcuate edge surface which engages said edge surface of said projection portion of said mass when said mass is in said unactuated position, said arcuate edge surface having a convex shape relative to said edge surface of said projection portion of said mass.

4. A deceleration sensor switch according to claim 2 wherein said enabling means includes a pair of contact ears extending parallel with each other, each contact ear having a convex-shaped arcuate edge surface which engages said edge surface of said projection portion of said mass when said mass is in said unactuated position.

5. A deceleration sensor switch according to claim 1 wherein said spring means includes a helical coil spring helically wound around said rod portion along its longitudinal central axis, at least one portion of said helical coil spring along the longitudinal central axis of said rod portion having a larger pitch than another portion.

6. A deceleration sensor switch according to claim 1 wherein said contact portion includes at least one contact finger and a silver nickel button welded onto said contact finger to increase the thermal mass of said contact finger and thereby to increase the current carrying capacity of said contact finger.

7. A deceleration sensor switch according to claim 3 wherein said mass is rectangular and said base includes a plate portion having a flat surface which is parallel with one side of said rectangular mass when said rectangular mass is mounted on said rod portion, said flat surface being spaced apart from said one side of said rectangular mass at a distance which prevents rotation of said rectangular mass about the longitudinal central axis of said rod portion and thereby prevents said edge surface of said projection portion of said rectangular mass from moving out of proper alignment relative to said arcuate edge surface of said enabling means.

8. A deceleration sensor switch according to claim 4 wherein said mass is rectangular and said base includes a plate portion having a flat surface which is parallel with one side of said rectangular mass when said rectangular mass is mounted on said rod portion, said flat surface being spaced apart from said one side of said rectangular mass at a distance which prevents rotation of said rectangular mass about the longitudinal central axis of said rod portion and thereby prevents said edge surface of said projection portion of said rectangular mass from moving out of proper alignment relative to said arcuate edge surface of said enabling means.

9. A deceleration sensor switch according to claim 1 further comprising a cover engageable with said base and for, when engaged with said base, enclosing said mass and said spring means.

10. A deceleration sensor switch according to claim 9 further comprising means disposed on said mass for preventing said cover from striking said connecting means when said cover is moved towards said base to engage said base.

11. A deceleration sensor switch according to claim 1 further comprising standoff means through which said first and second electrical terminals extend and for enabling said base to be mounted above a printed circuit board with space between said base and the printed circuit board in which components to be mounted on the printed circuit board may be accommodated.

12. A deceleration sensor switch comprising:

a base including a rod portion having a longitudinal central axis;

a rectangular mass mounted on said rod portion and movable relative to said rod portion between an unactuated position and an actuated position along the longitudinal central axis of said rod portion, said rectangular mass moving from said unactuated position to said actuated position when said rectangular mass is subjected to deceleration of a predetermined magnitude;

said base including a flat surface which is parallel with one side of said rectangular mass when said rectangular mass is mounted on said rod portion, said flat surface being spaced apart from said one side of said rectangular mass at a distance which prevents rotation of said rectangular mass about the longitudinal central axis of said rod portion;

spring means for providing a restoring force which acts on said rectangular mass to move said rectangular mass relative to said rod portion from said actuated position back to said unactuated position after said rectangular mass has moved to said actuated position;

a first electrical terminal and a second electrical terminal electrically connectable with said first electrical terminal; and connecting means for electrically connecting said first and second electrical terminals with each other when said rectangular mass moves from said unactuated position to said actuated position.

13. A deceleration sensor switch according to claim 12 wherein said rectangular mass has a square shape.

14. A deceleration sensor switch comprising:

a base including a rod portion having a longitudinal central axis;

a mass mounted on said rod portion and movable relative to said rod portion between an unactuated position and an actuated position along the longitudinal central axis of said rod portion, said mass moving from said unactuated position to said actuated position when said mass is subjected to deceleration of a predetermined magnitude;

spring means for providing a restoring force which acts on said mass to move said mass relative to said rod portion from said actuated position back to said unactuated position after said mass has moved to said actuated position;

a first electrical terminal and a second electrical terminal electrically connectable with said first electrical terminal;

connecting means for electrically connecting said first and second electrical terminals with each other when said mass moves from said unactuated position to said actuated position;

a cover engageable with said base and for, when engaged with said base, enclosing said mass and said spring means; and protection tab means disposed on said mass and for preventing said cover from striking said connecting means when said cover is moved towards said base to engage said base.

* * * * *